US006460523B1

(12) United States Patent
Gagnon

(10) Patent No.: US 6,460,523 B1
(45) Date of Patent: Oct. 8, 2002

(54) EGR SYSTEM FOR AN INTERNAL COMBUSTION ENGINE

(76) Inventor: Frèdèric Gagnon, 955 Grand Ave. West, #304, Chatham, Ontario (CA), N7L 4Z6

( * ) Notice: Subject to any disclaimer, the term of this patent is extended or adjusted under 35 U.S.C. 154(b) by 0 days.

(21) Appl. No.: 09/482,920

(22) Filed: Jan. 14, 2000

Related U.S. Application Data

(60) Provisional application No. 60/116,193, filed on Jan. 15, 1999.

(51) Int. Cl.[7] ..... F02M 25/07
(52) U.S. Cl. ..... 123/568.27; 123/568.29
(58) Field of Search ..... 123/568.27, 568.26, 123/568.17, 568.28, 568.29

(56) References Cited

U.S. PATENT DOCUMENTS 5,613,479 A * 3/1997 Gates et al. ..... 123/568.27
5,988,149 A * 11/1999 Gates ..... 123/568.27
6,116,224 A * 9/2000 Cook et al. ..... 123/568.27

* cited by examiner

*Primary Examiner*—Gene Mancene
*Assistant Examiner*—Arnold Castro

(57) ABSTRACT

An exhaust gas recirculation (EGR) system is provided having an electric vacuum regulator (EVR) valve mounted contiguously with a delta pressure feedback exhaust (DPFE) sensor to form an integral EVR/DPFE assembly. In turn, the EVR/DPFE assembly is mounted on a surface of the intake manifold of an internal combustion engine. A single port in the housing of the manifold provides a fluid connection to the EVR/DPFE sensor assembly. This connection provides a vacuum input connection to both the EVR valve and the DPFE sensor. The EVR/DPFE sensor assembly utilizes a single electrical connection to the engine control unit (ECU). The DPFE sensor measures a differential exhaust pressure at locations upstream and downstream of an orifice in a gasket sealing the EGR valve to the intake manifold. The upstream measurement location is in an EGR valve chamber, and the downstream location is in the intake manifold.

21 Claims, 3 Drawing Sheets

Prior Art

EGR SYSTEM FOR AN INTERNAL COMBUSTION ENGINE

CROSS REFERENCE TO CO-PENDING APPLICATION

This application claims priority to U.S. Provisional Application No. 60/116,193, filed Jan. 15, 1999, the disclosure of which is incorporated by reference herein in its entirety.

FIELD OF THE INVENTION

This invention relates to an automotive exhaust gas recirculation (EGR) system, and more particularly, to an EGR system having an electric vacuum regulator (EVR) valve and a delta pressure feedback exhaust (DPFE) sensor combined in a single assembly and mounted on the intake manifold of an internal combustion engine.

BACKGROUND OF THE INVENTION

Various systems have been developed to reduce the emission of undesirable combustion products, such as nitrogen oxides (NOX), from internal combustion engines. One such system is the exhaust gas recirculation (EGR) system. In EGR systems, a portion of the engine exhaust is recirculated into the intake manifold where it mixes with incoming air. The mixture of the exhaust gases with the air-fuel mixture in the engine cylinders provides lower peak temperatures during combustion, resulting in a reduction in the quantity of NOX produced.

Known EGR systems utilize an EGR tube to divert a portion of an engine's exhaust gases from the exhaust pipe back into the intake manifold. A schematic of a known system is shown in FIG. 1. A vacuum-operated EGR valve is arranged between the EGR tube and the intake manifold to regulate the flow of exhaust gases into the manifold. The intake manifold provides the vacuum source for operating the EGR valve. A first hose connects the manifold to an electric vacuum regulator (EVR) valve, and a second hose connects the EVR valve to the EGR valve. The EVR valve receives a control signal from the engine control unit (ECU) and regulates the amount of vacuum provided to the EGR valve, which in turn limits the flow of exhaust gases into the intake manifold.

The ECU computes the EVR control signal based on a measurement of the differential pressure of exhaust gases between two points in the EGR tube. The differential pressure reflects the amount of flow of exhaust gases in the system. The pressure measurement is obtained using a delta pressure feedback exhaust (DPFE) sensor. The DPFE sensor operates by measuring the pressure of exhaust gases at a locations on either side of a flow restriction, or orifice, in the EGR tube. The orifice and measurement locations are positioned upstream of the EGR valve. Two more hoses connect the DPFE sensor to measurement taps on the EGR tube. The DPFE continually computes a delta pressure value for the exhaust gases in the tube and provides the data to the ECU. The ECU then uses this data to compute the EVR control signal.

There are several drawbacks associated with known EGR systems. The individual sensors and actuators used in these systems each require mounting brackets, electrical connections, and input and outlet hoses. Further, the DPFE orifice and hose connections on the EGR tube require additional manufacturing steps during production of the tube. Finally, the components in proximity to the exhaust system must be made from special heat-resistant materials to allow them to withstand the heat produced by the exhaust gases. The additional, specialized parts and the added manufacturing and assembly steps result in high production costs.

SUMMARY OF THE INVENTION

The present invention provides an exhaust gas recirculation (EGR) system having an electric vacuum regulator (EVR) valve mounted contiguously with a delta pressure feedback exhaust (DPFE) sensor on a surface of the intake manifold of an internal combustion engine. The EGR system incorporating the integral EVR/DPFE sensor assembly requires fewer parts than known systems, by virtue of eliminating numerous mounting brackets, hoses, and electrical connections. Because the EVR/DPFE sensor assembly operates in a low temperature environment, no expensive heat-shielding materials are required. The EVR/DPFE sensor of the present invention utilizes only two fluid connection hoses, and a single electrical connection to the engine control unit (ECU). Further, the inventive EGR system utilizes an EGR tube without an orifice or measurement taps, thereby eliminating manufacturing and assembly steps.

In one embodiment, the EVR valve is mounted contiguously with a DPFE sensor on a surface of the intake manifold. Alternatively, the EVR/DPFE sensor assembly may be formed with a monolithic housing. A single, common port from the manifold provides a fluid connection to the EVR/DPFE sensor assembly. This connection provides a vacuum input connection to the EVR valve and the DPFE sensor.

The DPFE sensor measures a differential exhaust pressure at locations upstream and downstream of an orifice in a gasket sealing the EGR valve to the intake manifold. The upstream measurement location is in an EGR valve chamber, and the downstream location is in the intake manifold. The orifice in the inventive system, therefore, is located downstream of the EGR valve.

The present invention provides an apparatus controlling an exhaust gas recirculation valve for an internal combustion engine. The exhaust gas recirculation valve supplies exhaust gas from an exhaust pipe to vacuum in an intake manifold. The system comprises an electric vacuum regulator valve generally enclosed in a first housing, and a delta pressure feedback exhaust gas recirculation sensor generally enclosed in a second housing, the second housing contiguously engaging the first housing.

The present invention also provides an exhaust gas recirculation system for an internal combustion engine having an intake system and an exhaust system. The exhaust gas recirculation system comprises an intake manifold defining a part of the intake system; a delta pressure feedback exhaust gas recirculation sensor having a first fluid connection to the exhaust system and a second fluid connection to the intake manifold; an exhaust gas recirculation valve regulating flow of exhaust gas to the intake manifold; and an orifice in fluid communication between the intake manifold and the exhaust gas recirculation valve, the orifice having a downstream side connecting to the first fluid connection and an upstream side connecting to the second fluid connection.

The present invention further provides an exhaust gas recirculation system for an internal combustion engine having an intake system and an exhaust system. The exhaust gas recirculation system comprises an intake manifold defining a part of the intake system, and at least one of an electric vacuum regulator valve and a delta pressure feedback exhaust gas recirculation sensor being mounted on the intake manifold.

The present invention yet further provides a method of recirculating exhaust gas in an internal combustion engine having an intake system and an exhaust system. The method comprises providing an intake manifold defining a part of the intake system; providing an exhaust gas recirculation valve in a conduit connecting the exhaust system to the intake system; providing an electric vacuum regulator valve connected in fluid communication between the intake manifold and the exhaust gas recirculation valve; and providing a delta pressure feedback exhaust gas recirculation sensor measuring a differential in pressure between the intake manifold and the conduit.

BRIEF DESCRIPTION OF THE DRAWINGS

The accompanying drawings, which are incorporated herein and constitute part of this specification, illustrate presently preferred embodiments of the invention and, together with the general description given above and the detailed description given below, serve to explain features of the invention.

DETAILED DESCRIPTION OF THE PREFERRED EMBODIMENT

Figure 1:
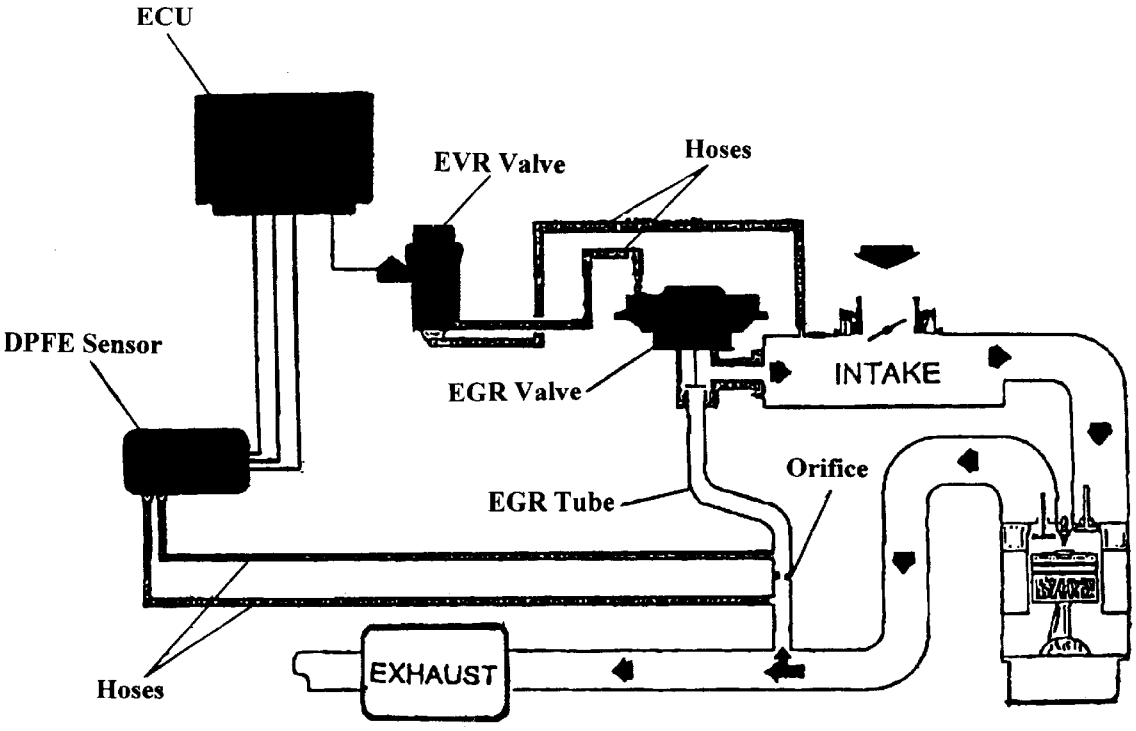
FIG. 1 is a schematic of a conventional EGR system.
Figure 2:
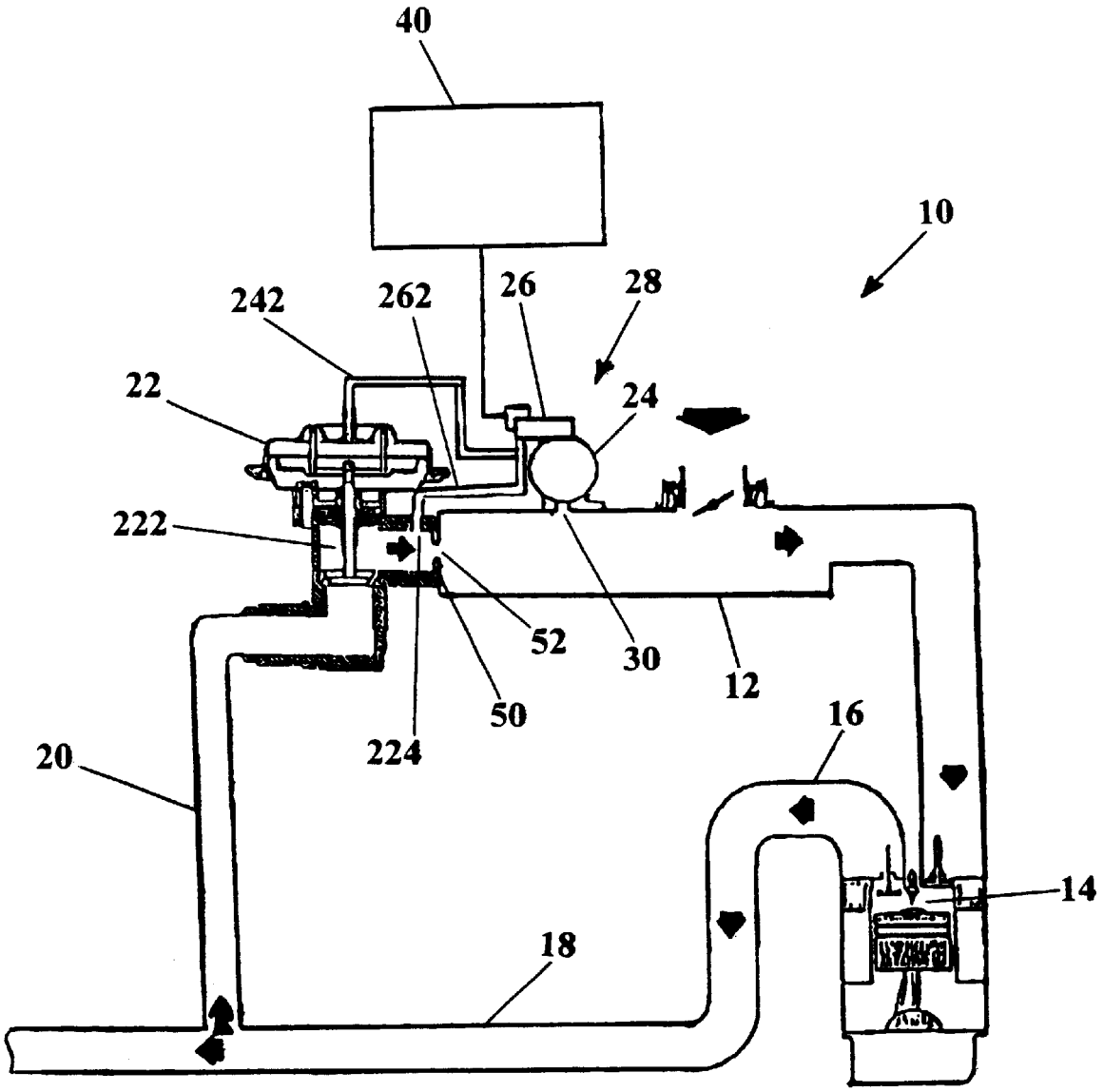
FIG. 2 is a schematic of an EGR system according to the present invention.

FIG. 2 illustrates an embodiment of the EGR system 10 according to the present invention. As shown, air is drawn in through the intake manifold 12 and proceeds to an engine cylinder 14 where combustion takes place. The resultant combustion products (exhaust gases) are expelled into the exhaust manifold 16 and flow out an exhaust system including an exhaust pipe 18. An EGR tube 20 is used to recirculate a portion of the exhaust gases from the exhaust pipe 18 to the intake manifold 12. A vacuum-operated EGR valve 22 is arranged between the EGR tube 20 and the intake manifold 12 to regulate the flow of exhaust gases into the manifold 12. The EGR valve 22 can be mounted directly to the intake manifold 12, which provides the vacuum source for operating the EGR valve 22.

Figure 3:
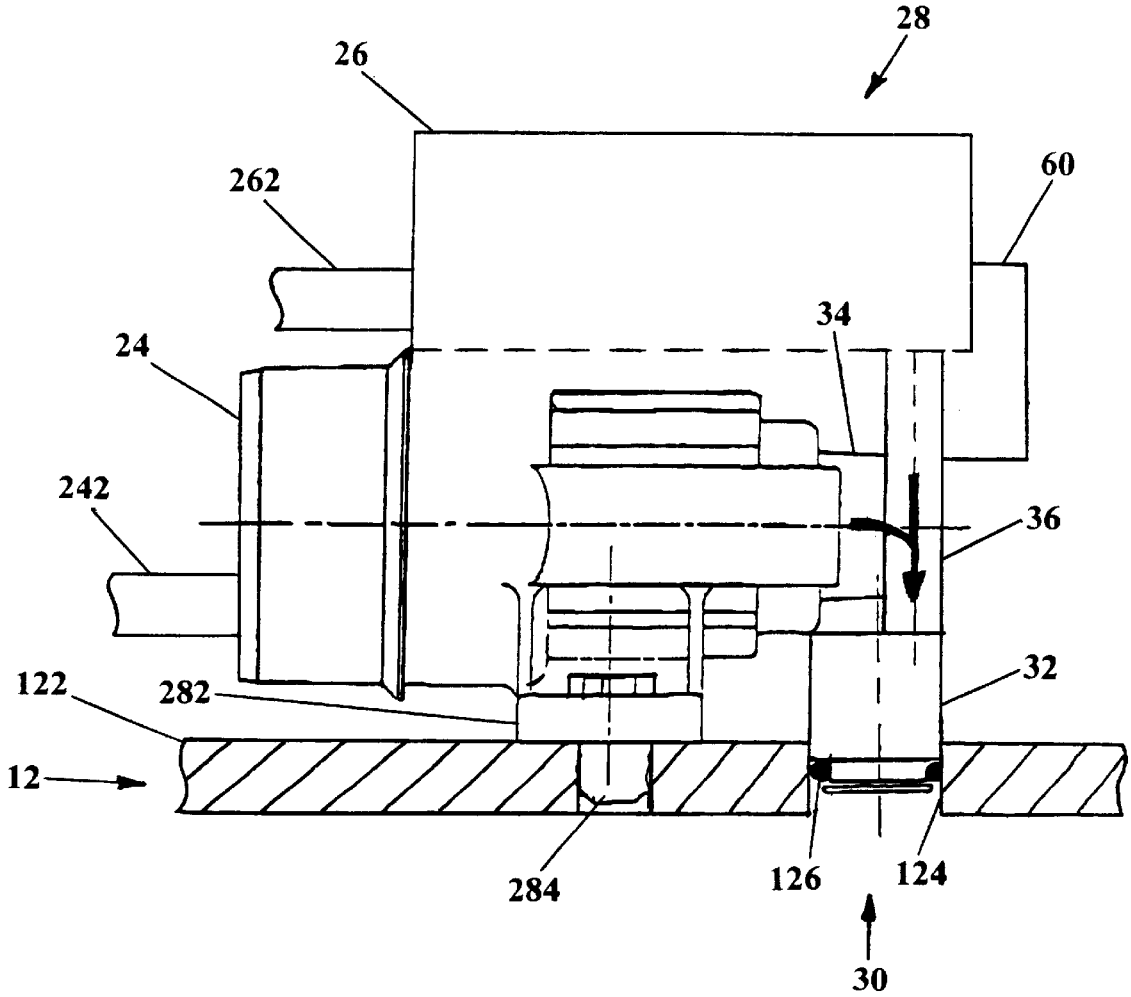
FIG. 3 is a schematic illustration showing an integral EVR/DPFE assembly according to the present invention.

The supply of vacuum to the EGR valve 22 is regulated by an EVR valve 24, which is attached to a surface of the intake manifold 12. EVR valves of this type are disclosed in commonly-assigned U.S. Pat. No. 5,448,981 to Cook et al. and U.S. Pat. No. 5,967,172 to Cook, which are incorporated herein in their entirety by reference. In one embodiment of the present invention, the EVR valve 24, and a sensor 26 described hereinafter, are mounted contiguously on a surface 122 of the intake manifold 12, as shown in FIG. 3. A fluid connection 30 is made between the intake manifold 12 and the EVR valve 24 with a port 124 through the housing 122 of the intake manifold 12. This connection is operatively sealed by an O-ring 126. The fluid connection from the EVR valve 24 to the EGR valve 22 is made using a hose 242. The EVR valve 24 receives a control signal from the ECU 40 and regulates the amount of vacuum provided to the EGR valve 22, which in turn regulates the flow of exhaust gases into the intake manifold 12.

The ECU 40 computes the EVR control signal based on a measurement of the differential pressure of exhaust gases between a point 224 in a chamber 222 of the EGR valve 22 and a point 30 in the intake manifold 12. This differential measurement reflects the amount of flow of exhaust gases in the system. The pressure measurement is obtained using a DPFE sensor 26, which is mounted contiguously with respect to the EVR valve 24 on a surface 122 of the intake manifold 12, forming an integral EVR/DPFE sensor assembly 28, shown in FIG. 3.

The DPFE sensor 26 operates by measuring the pressure of exhaust gases at locations upstream and downstream of a flow restriction or orifice 52, shown in FIG. 2. The orifice 52 can be located between the EGR valve chamber 222 and the intake manifold 12. In one embodiment, the orifice 52 is formed in a thin gasket 50 which seals the EGR valve 22 onto the intake manifold 12. The gasket 50 can be made of stainless steel, which provides dimensional stability at high temperatures, although other materials exhibiting similar properties can be used. Notably, according to the present invention the orifice 52 and DPFE measurement locations 224, 30 can be positioned downstream of the EGR valve 22.

The DPFE sensor 26 connects with the downstream measurement location 30 using the same port 124 through the manifold housing 122 as is used by the EVR valve 24. Thus the port 124 provides a source of vacuum for both the EGR valve 22 (as regulated by the EVR valve 24) and the DPFE sensor 26. A hose 262 connects the DPFE sensor 26 with the upstream measurement location 224. The DPFE sensor 26 continually computes a differential pressure value for the exhaust between the measurement locations 224, 30 and provides this data to the ECU 40. The ECU 40 then uses this data to compute the EVR control signal.

A description of one embodiment of the integral EVR/DPFE sensor assembly 28 will now be provided with reference to FIG. 3. In the embodiment shown, the EVR valve 24 and the DPFE sensor 26 are mounted contiguously with respect to one another on a surface 122 of the intake manifold 12 to form the integral EVR/DPFE sensor assembly 28. The assembly 28 has a bracket 282 secured to the surface 122 of the intake manifold 12 with a bolt 284, although other equivalent attachment means can be used. Further the DPFE sensor 26 can be attached to the EVR valve 24 using clips or other attachment means, or the assembly 28 can be formed with a monolithic housing.

A port 124 in the surface 122 of the intake manifold 12 provides a single fluid connection 30 to the EVR/DPFE sensor assembly 28. The port 124 leads to a channel 32 having first and second branches 34, 36 to provide an input vacuum line for the EVR valve 24 and the DPFE sensor 26. The EVR/DPFE sensor assembly 28 utilizes a single electrical connection 60 to the ECU 40. In one embodiment the EVR/DPFE sensor assembly 28 utilizes a six-pin connector, but other equivalent connections arc within the scope of the invention.

Alternatively, the EVR valve 24 and the DPFE sensor 26 can be separately mounted directly to a surface 122 of the intake manifold 12. In this arrangement, a port is formed through the manifold housing at the location of each component to provide the necessary fluid connections.

While the invention has been disclosed with reference to certain preferred embodiments, numerous modifications, alterations, and changes to the described embodiments are possible without departing from the sphere and scope of the invention, as defined in the appended claims and their equivalents thereof. Accordingly, it is intended that the invention not be limited to the described embodiments, but that it have the full scope defined by the language of the following claims.

What I claim is:

1. An apparatus controlling an exhaust gas recirculation valve for an internal combustion engine, the exhaust gas recirculation valve supplying exhaust gas from an exhaust pipe to vacuum in an intake manifold, the system comprising:

an electric vacuum regulator valve generally enclosed in a first housing; and a delta pressure feedback exhaust gas recirculation sensor generally enclosed in a second housing the second housing contiguously engaging the first housing, wherein at least one of the electric vacuum regulator valve and the delta pressure feedback exhaust gas recirculation sensor being mounted on the intake manifold.

2. The apparatus according to claim 1, wherein the electric vacuum regulator valve and the delta pressure feedback exhaust gas recirculation sensor arc connected to a common intake manifold port.

3. The apparatus according to claim 2, wherein the electric vacuum regulator valve includes a fluid passageway extending between a entrance to the first housing and an exit from the first housing, and a branch connecting the fluid passageway to an interior chamber; and wherein the delta pressure feedback exhaust gas recirculation sensor includes a first measurement chamber communicating with the exit from the first housing.

4. The apparatus according to claim 3, wherein the delta pressure feedback exhaust gas recirculation sensor includes a second measurement chamber communicating with the exhaust gas.

5. The apparatus according to claim 1, further comprising at least one fastener securing the first housing to the second housing.

6. The apparatus according to claim 1, wherein in the first housing and the second housing define a monolithic body.

7. The apparatus according to claim 6, wherein the monolithic body includes a common port connecting the electric vacuum regulator valve and the delta pressure feedback exhaust gas recirculation sensor to the intake manifold.

8. The apparatus according to claim 7, wherein the monolithic body includes a first connection port connecting the electric vacuum regulator valve to an exhaust gas recirculation valve, and a second connection port connecting the delta pressure feedback exhaust gas recirculation sensor to the exhaust gas.

9. The apparatus according to claim 8, wherein the second connection port connects to the exhaust gas between the exhaust gas recirculation valve and the intake manifold.

10. The apparatus according to claim 8, wherein the common port connects to the vacuum on a first side of an orifice plate, and the second connection port connects to the exhaust gas on a second side of the orifice plate.

11. An exhaust gas recirculation system for an internal combustion engine having an intake system and an exhaust system, the exhaust gas recirculation system comprising:

an intake manifold defining a part of the intake system;

a delta pressure feedback exhaust gas recirculation sensor having a first fluid connection to the exhaust system and a second fluid connection to the intake manifold;

an exhaust gas recirculation valve regulating flow of exhaust gas to the intake manifold and an orifice in fluid communication between the intake manifold and the exhaust gas recirculation valve, the orifice having an upstream side connecting to the first fluid connection and a downstream side connecting to the second fluid connection, wherein at least one of the electric vacuum regulator valve and the delta pressure feedback exhaust gas circulation sensor being mounted on the intake manifold.

12. The exhaust gas recirculation system according to claim 11, further comprising:

an electric vacuum regulator valve in fluid communication between the intake manifold and the exhaust gas recirculation valve.

13. The exhaust gas recirculation system according to claim 12, further comprising:

a housing integrally containing the electric vacuum regulator valve and delta pressure feedback exhaust gas recirculation sensor.

14. The exhaust gas recirculation system according to claim 11, further comprising:

a common fluid port on the intake manifold for both the electric vacuum regulator valve and the delta pressure feedback exhaust gas recirculation sensor.

15. An exhaust gas recirculation system for an internal combustion engine having an intake system and an exhaust system, the exhaust gas recirculation system comprising:

an intake manifold defining a part of the intake system; and at least one of an electric vacuum regulator valve and a delta pressure feedback exhaust gas recirculation sensor being mounted on the intake manifold, the electric vacuum regulator valve being generally enclosed in a first housing, the delta pressure feedback exhaust gas recirculation sensor being generally enclosed in a second housing, and the second housing contiguously engaging the first housing.

16. A method of recirculating exhaust gas in an internal combustion engine having an intake system and an exhaust system, the method comprising:

providing an intake manifold defining a part of the intake system;

providing an exhaust gas recirculation valve in a conduit connecting the exhaust system to the intake system;

providing an electric vacuum regulator valve connected in fluid communication between the intake manifold and the exhaust gas recirculation valve;

providing a delta pressure feedback exhaust gas recirculation sensor measuring a differential in pressure between the intake manifold and the conduit; and mounting on the intake manifold at least one of the electric vacuum regulator valve and the delta pressure feedback exhaust gas recirculation sensor.

17. The method according to claim 16, further comprising:

connecting in fluid communication both a first side of the delta pressure feedback exhaust gas recirculation sensor and an input to the electric vacuum regulator valve to a common port on the intake manifold.

18. The method according to claim 17, further comprising:

connecting in fluid communication a second side of the delta pressure feedback exhaust gas recirculation sensor to the conduit between the exhaust gas recirculation valve and the intake manifold.

19. The method according to claim 16, further comprising:

providing an orifice at an interface between the conduit and the intake manifold.

20. The method according to claim 16, further comprising:

contiguously mounting the delta pressure feedback exhaust gas recirculation sensor with respect to the electric vacuum regulator valve.

21. The method according to claim 16, further comprising:

connecting an electronic controller to both the electric vacuum regulator valve and the delta pressure feedback exhaust gas recirculation sensor with a single multi-conductor connector.

* * * * *